United States Patent [19]

Dzik

[11] Patent Number: 4,811,952

[45] Date of Patent: Mar. 14, 1989

[54] FLIGHT DESTINATION BOARD GAME

[76] Inventor: Stanley J. Dzik, 6837 Harriet Ave. S., Richfield, Minn. 55423

[21] Appl. No.: 489,156

[22] Filed: Apr. 27, 1983

[51] Int. Cl.[4] ..... A63F 3/02

[52] U.S. Cl. ..... 273/258; 273/260

[58] Field of Search ..... 273/258, 260

[56] References Cited

U.S. PATENT DOCUMENTS

| | | | |
|---|---|---|---|
| 1,335,511 | 3/1920 | Laffargue | 273/258 |
| 1,418,409 | 6/1922 | Wakefield | 273/260 |
| 1,624,970 | 4/1927 | Owye | 273/260 |
| 1,628,134 | 5/1927 | Finlay | 273/260 |
| 1,877,154 | 9/1932 | Weaver | 273/260 |
| 2,026,082 | 12/1935 | Darrow | 273/256 |
| 3,709,498 | 1/1973 | Liston | 273/260 |
| 3,730,527 | 5/1973 | Nelson | 273/258 |
| 3,747,933 | 7/1973 | Parker | 273/260 |
| 3,787,056 | 1/1974 | Hellmann | 273/251 |
| 3,902,724 | 9/1975 | Hersey | 273/258 |
| 3,926,437 | 12/1975 | Moe et al. | 273/260 |
| 4,032,154 | 6/1977 | Magiera | 273/256 |
| 4,283,059 | 8/1981 | Beeder | 273/256 |

*Primary Examiner*—Richard C. Pinkham
*Assistant Examiner*—Benjamin Layno
*Attorney, Agent, or Firm*—Robert C. Baker

[57] ABSTRACT

The game apparatus for flight destination play by opposing players consists essentially of a playing board and two sets of movable markers. Each set includes a destination marker, a flight marker, and a plurality of offensive-defensive markers representing air vehicles. The board comprises a playing field of landing sites equally spaced one from the other in an array of north-south and east-west rows. The outermost east-west rows at opposing ends are base rows and the immediately inward east-west rows parallel thereto are secondary rows. Each base row has one landing site for a player's flight marker at the start of play. All other landing sites of the base and secondary rows at the same end are for that player's offensive-defensive markers. Airport indicia are on each base row landing site. A destination marker site is outwardly adjacent each airport indicia base row landing site for elective placement of the destination marker of the player whose flight marker is at the opposing end. Two visually distinct landing sites are medially located on the board between the secondary rows for allowing a player whose predetermined marker occupies either of the same during play to change his destination marker location and thereby shift his flight destination.

10 Claims, 2 Drawing Sheets

Fig. 1.
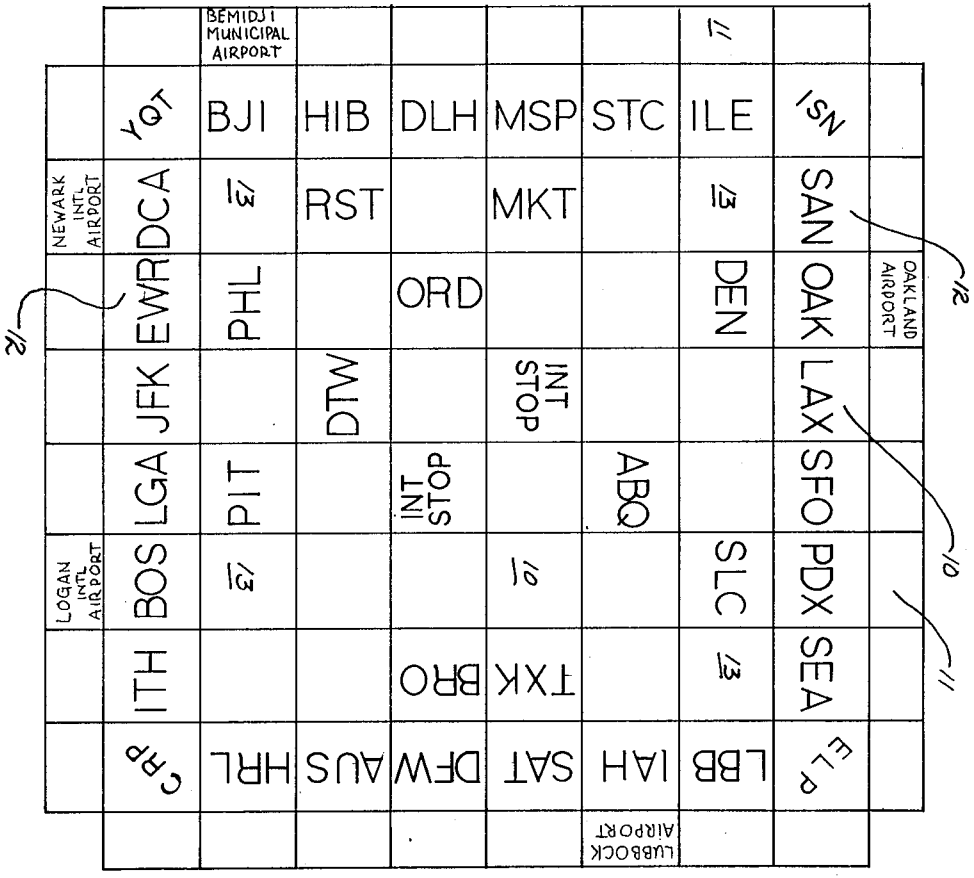
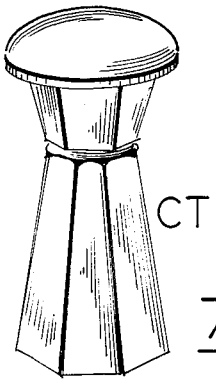
Fig. 2.
Fig. 3.
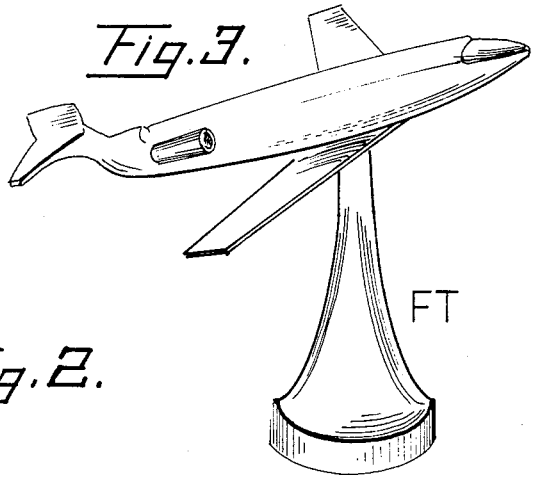

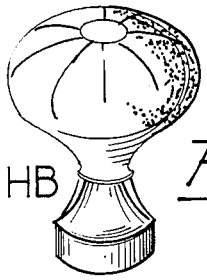
Fig. 4
Fig. 7.
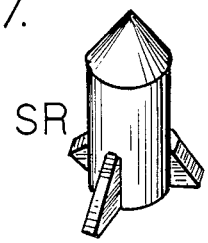
Fig. 5.
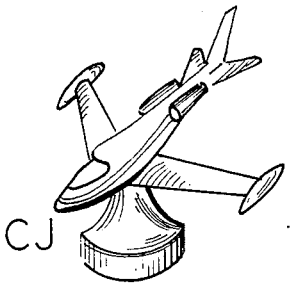
Fig. 8.
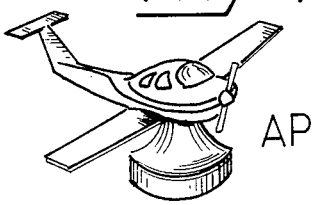
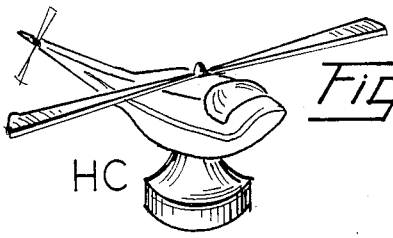
Fig. 6.
| | | | | | | | | |
|---|---|---|---|---|---|---|---|---|
| | | | | CT | | | | |
| | HB | HC | CJ | SR | FT | CJ | HC | HP |
| | AP | AP | AP | AP | AP | AP | AP | AP |
| | | | | | | | | |
| | | | | | | | | |
| | | | | | | | | |
| | | | | | | | | |
| | AP | AP | AP | AP | AP | AP | AP | AP 13 |
| | HB | HC | CJ | FT | SR | CJ | HC | HB 12 |
| | | CT | | | | | | |
Fig. 9.

FLIGHT DESTINATION BOARD GAME

FIELD OF THE INVENTION

This invention relates to flight game apparatus for flight destination play by opposing players.

DESCRIPTION OF PRIOR ART

No directly pertinent prior art is known, although some movements for the markers in my game are analogous to those in the old game of chess. However the old game of chess lacks a destination marker for elective placement and requires checkmating, which is entirely lacking and not a part of my game teaching.

SUMMARY OF THE INVENTION

The invention provides game apparatus for flight destination play by opposing players. The apparatus consists essentially of a playing board and two sets of markers. Each set of markers includes a destination marker, a flight marker, and a plurality of offensive-defensive markers representing air vehicles of various types. The markers of one set are visually distinct from the markers of the other set. For example, one set may be black and the other white. The board comprises a playing field of landing sites equally spaced one from the other in an array of north-south and east-west rows. The outermost east-west rows at opposing ends of the board are base rows and the immediately inward east-west rows parallel and adjacent to those base rows are secondary rows. Each opposing base row has one landing site adapted to receive a flight marker at the start of play. All other landing sites of the base row and of the secondary row at the same end of the board are adapted to receive offensive-defensive markers of the same set as the flight marker at that end of the board at the time the play is started. Airport indicia is on each base row landing site. A destination marker site is located outwardly adjacent each airport indicia base row landing site for elective placement of the destination marker of the player whose flight marker is at the opposing end of the board at the start of play. Further, means consisting essentially of two visually distinct landing sites medially located on the board between the secondary rows thereof are provided for allowing a player whose predetermined marker (e.g., flight marker) occupies either of the visually distinct landing sites during play to change the initially elected placement of said player's destination marker and thereby shift the flight destination of said player's flight marker.

Engaging in flight destination play involves electively selecting one's destination airport and placing one's destination marker at the destination marker site applicable for said destination. Each player does this; and the destination airport selected is at the opposite end of the board from the end where the player's flight marker is placed at the start of the game. The opposing players then take turns of play. The objective is to move one's flight marker from its starting location to the destination airport for that flight, and to do so without cancellation of the flight. All movements of markers are governed by predetermined conditions limiting freedom of movement, with either opponent entitled to cancel and remove from the playing board the markers of the opposing player under predetermined conditions equally applicable to both players. Cancellation of a player's flight marker precludes that player from winning, but that player may still accomplish a "draw" by successfully effecting cancellation of his opponent's flight.

THE DRAWING

FIG. 1 is a schematic representation of a playing board in accordance with the invention, with some parts not fully labeled but having significance as will be more fully explained below;

FIGS. 2 through 8 inclusive are schematic representations of air vehicle markers of the invention, and respectively show: Control Tower CT, Flight FT, Hotair Balloon HB, Commuter Jet CJ, Helicopter HC, Shuttle Rocket SR, and Airplane AP; and FIG. 9 is a schematic representation of reduced size illustrating a set-up of the game equipment for starting play.

DESCRIPTION OF PREFERRED EMBODIMENT

Referring to FIG. 1, the game board of the invention is equipped with an array of sixty-four landing sites 10 equally spaced one from the other in an arrangement of perpendicularly-aligned north-south and east-west rows. In viewing the drawing, the north-south direction is vertical and the east-west direction is horizontal. The use of compass directions is done for convenience and the belief that it contributes to clarity. The illustrated game board is capable of being used by opposing players whether they sit at the east-west ends or the north-south ends. In this respect, it should be observed that destination marker sites 11 are outwardly adjacent each airport indicia base row landing site 12 at all "ends" or sides of the board.

Regardless of which "compass" direction is chosen for the orientation of the board between opposing players, the direction between the players is assumed to be north-south. It will be noted that the outermost east-west oriented row of landing sites most adjacent each player is always a base row 12, and the immediately inward row of landing sites parallel and adjacent to each base row is a secondary row site 13. Thus, regardless of the orientation employed, airport indicia (e.g., SAN) is on each base row landing site. Illustratively, the airport indicia on the base row landing sites, going clockwise around the perimeter portion of the board, starting at the upper left site ISN, has significance and meaning as set forth in the following table:

| | |
|---|---|
| ISN | Willisinton Airport |
| SAN | Lindberg Field - San Diego |
| OAK | Oakland Airport |
| LAX | Los Angeles Intl. Airport |
| SFO | San Francisco Intl. Airport |
| PDX | Portland Intl. Airport |
| SEA | Seattle-Tacoma Intl. Airport |
| ELP | El Paso Intl. Airport |
| LBB | Lubbock Airport |
| IAH | Houston Intercontinental Airport |
| SAT | San Antonio Intl. Airport |
| DFW | Dallas-Ft. Worth Regional Airport |
| AUS | Mueller Municipal Airport |
| HRL | Harlington Airport |
| CRP | Corpus Christi Airport |
| ITH | Ithaca Municipal Airport |
| BOS | Logan Intl. Airport |
| LGA | LaGuardia Airport |
| JFK | John F. Kennedy Intl. Airport |
| EWR | Newark Intl. Airport |
| DCA | Washington Nat'l Airport |
| YQT | Thunderbay Intl. Airport |
| BJI | Bemidji Municipal Airport |
| HIB | Chisholm-Hibbing Airport |

-continued

| | |
|---|---|
| DLH | Duluth Intl. Airport |
| MSP | Minneapolis-St. Paul Intl. Airport, Wold-Chamberlain Field |
| STC | St. Cloud Municipal Airport |
| ILE | Killeen Municipal Airport |

While not illustrated in the drawing (solely to avoid excessive and confusing marking in the small size for the drawing as submitted), each and every landing site of the board may suitably carry or have on it a predetermined airport indicia (usually of 3 letters), as well as a phone number for any elected airline reservations desk in the city serviced by that airport. Further, each destination marker site 11 suitably has indicia or labeling on it descriptive of the airport of that destination (e.g., Oakland Airport for OAK).

Two landing sites (marked "INT STOP" in FIG. 1) medially located on the board between the secondary rows (regardless of which direction the board is used for play) are of special character. These two landing sites are visually distinct from all others and constitute means for allowing or permitting a player whose predetermined marker occupies either of these visually distinct landing sites during play to change his initially elected destination for his flight by moving his destination marker. The destination selection, however, is suitably limited to a destination at the end of the board opposite the starting location of the player's flight marker. The change of destination, if done, causes a shift of the thrust of offensive-defensive play, or alters the effectiveness of the defensive posture of an opponent's markers, or enhances the offensive posture of markers (particularly the flight marker) of the player electing to change his destination. These two visually distinct landing sites suitably carry the indicia "Inter Stop", meaning "intermediate stop." Preferably, it is only when the player's flight marker occupies one of these special landing sites that the player has the option of changing his destination marker location and therefore the destination objective for his flight marker. For reasons set forth below, it will be evident that a player's movement of his flight marker to and on one of those visually distinct landing sites is not easily accomplished without hazard. And as a practical matter, a player will not move his flight marker onto one of those visually distinct landing sites except under conditions where his flight marker is believed by him to be free of any imminent hazard.

The total number of markers for each player is seventeen, sixteen of which are used as movable markers on landing sites of the playing board and one of which is employed as a movable marker on a destination marker site 11.

The destination marker (FIG. 2) illustratively consists of a control tower CT configuration, and this is truly representative of the objective for the flight of the player.

The flight marker FT (FIG. 3) suitably consists of a piece representative of a large commercial aircraft such as a Boeing 747. This particular marker is the most powerful one on the playing board. It may be moved only in a straight direction at any turn of play; but it may move either east-west or north-south or diagonally. It may be moved for so far as (or less than) the line for its movement is unobstructed, that is, free of any other marker except an opponent's marker on the terminal end landing site of its movement. If the elected line and distance of movement includes such a terminal landing site (occupied by an opponent's marker), the opponent's marker is "cancelled", that is, the air vehicle (including flight marker) represented by the opponent's marker is removed from play, taken off the board, and not replaceable during play. All cancellations as discussed hereinbelow are effected in this manner.

The markers representing hotair balloons HB (FIG. 4) are limited in movement to either east-west or north-south directions. They may be moved for so long a distance as their movement is unobstructed or terminates at a landing site occupied by an opponent's marker, in which event the opponent's marker is cancelled. It will be recognized that the hotair balloon movement is analogous to that for the rook in the game of chess.

Those markers representing commuter jets CJ (FIG. 5) are limited to movement from landing site to landing site in straight diagonal directions only. Their movement is analogous to that for the bishop in the game of chess (e.g., where checkerboard coloring is employed for the playing board, that is, light and dark coloring is employed alternately for the sites of the board, with sites of parallel adjacent diagonal direction alternately dark and light, each commuter jet is capable of movement only to a site of the color on which the commuter jet was located at the start of a game). They, too, may be moved only the distance of unobstructed movement or movement terminating at a landing site occupied by an opponent's marker, which is then cancelled.

Markers representing helicopters (HC (FIG. 6) are analogous to the knights of chess in their movement and ability to cancel and remove an opponent's marker. Specifically, the helicopter moves by jumping from landing site to landing site. Unlike other pieces or markers, it does not move in a straight line; and it cannot be obstructed by any intervening piece or marker. Its movement is controlled by the principle of shifting just one landing site in an east-west or north-south direction and one landing site in a diagonal direction therefrom, just as the knight's movement is limited in the game of chess. Specifically, movement of one's helicopters is limited to landings at landing sites either free of any marker or occupied by an opponent's marker; if the latter, the opponent's marker is cancelled.

The shuttle rocket marker SR (FIG. 7) is extremely limited in its movement and solely may move one landing site at a turn of play and solely in either the east-west or north-south direction, not diagonally. It is probably the weakest piece on the board. It is not in any way analogous to the king in the game of chess. Its movement is limited to landing sites either free of any marker or occupied by an opponent's marker; if the latter, the opponent's marker is cancelled.

The airplane markers AP (FIG. 8) occupy the secondary row 13 at each player's end at the start of the game. Their movement is limited at all times to only one landing site at each turn of play. Further, their movement is limited to movement toward the opposite end of the board (until they reach that end), in the north-south direction only, except when they are employed to cancel an opponent's marker. The movement of an airplane may be blocked by any marker in front of it in the column of landing sites for its movement. An airplane may not cancel any opponent's marker immediately in front of it in the column of its movement. However, an airplane may move in a diagonal direction, just one landing site, to cancel and remove an opponent's piece occupying that diagonal landing site. Further, should an airplane, moving just one landing site at a turn of play, ever reach the opposite end of the playing board, that is a last landing site or the base row landing site on the opposite end of the board, then and in that event the airplane may move in a backward direction down that column of landing sites, one landing site at a turn, toward the secondary row of its starting position. Indeed, if an airplane is thus successfully moved one landing site at a turn of play and thus returned to the east-west row of its beginning position at the start of play, it may then be moved forward again (or up that column) and re-assume its original character as a marker or piece which is capable of cancelling an opponent's marker by a diagonal one landing site movement.

Reference is now made to FIG. 9 where the positioning of the markers for starting play is illustrated. Observe that the base row immediately in front of a player is occupied by the markers of his selected color and in the following sequence from left to right: Hotair Balloon HB, Helicopter HC, Commuter Jet CJ, Flight FT, Shuttle Rocket SR, Commuter Jet CJ, Helicopter HC, and Hotair Balloon HB. The entire secondary row of the player is occupied by Airplanes AP bearing the same color or visual distinctiveness as the base row markers of the player. Illustratively, the destination piece or Control Tower CT of the player is on the side of the board opposite the player in a destination marker site as selected by the player and located outwardly adjacent the airport indicia landing site selected by the player as his destination.

Recognizing that the objective of the game is to place one's flight marker in the landing site carrying the airport indicia of the destination marker of the player, without however losing one's flight marker as a result of cancellation either before or immediately after arriving in that landing site, it will be appreciated that a part of the defensive play is to so move and position one's markers in play as to obstruct free passage of an opponent's flight into his destination airport landing site. However, excessive concentration on defensive play, employing one's markers to obstruct an opponent, presents little opportunity for a player to win by achieving a completion of his flight to his destination airport. Further, a quick change of destination objective is possible where an offensive player is successful in moving his flight marker onto a landing site of the visually distinct indicia permitting alteration of his destination. An important element of play, however, is that of requiring a player to alert his opponent to the fact that the player expects to arrive at his destination airport landing site on his very next turn of play. Thus, a player, during his turn of play just before his "final" turn (i.e., that turn of play where he intends to land his flight marker at the landing site for his destination control tower CT) must alert his opponent by announcing "Final Approach." The opponent then, during the opponent's next turn of play, must take action to prevent or bar successful completion of that "Final Approach". If he doesn't, the player who announced "Final Approach" will then at his "final" turn of play move his flight marker onto the landing site of his destination control tower, and thus be the winner of the game.

The means permitting change of flight destination introduces an element of quick surprise to an opponent, and enhances the speed for completion of play with a "win" achieved.

Most importantly, the means for changing destination presents an "unknown" or sense of uncertainty during play. That uncertainty is of a character not heretofore present in games requiring the type of skill promoted by my game apparatus.

However, totally distinct from the game of chess, the objective (i.e., destination) in my game is that of a particular landing site, which may be changed only under the special condition involving the "Int Stop" sites as aforementioned. Checkmate is not involved in my game; and a varied location (e.g., king movement) for the checkmate objective of chess is not part of my game. Even so, a suitable term for my game is "Airline Chess", with recognition that the emphasis is on flight completion to a preselected destination airport.

The illustrative markers for my flight game may vary in size or contour from those expressly set forth herein and may even be representative of other air vehicles than those specifically shown without departing from the essential spirit of the invention as set forth in the claims appended hereto and made a part of this disclosure. Equivalents known and developed hereafter may be employed; and in this respect the claims appended hereto and made part of this disclosure should be construed as broadly as consistent with their validity. If desired, magnetic features may be employed for holding markers at sites on the playing board, or cooperative temporary interlocking between markers and board sites may be employed.

That which is claimed is:

1. Game apparatus for flight destination play by opposing players, consisting of a playing board and two sets of movable markers, each said set including a single destination marker, a flight marker, and a plurality of offensive-defensive markers representing air vehicles, with all markers of one said set visually distinct from all markers of the other said set, said board comprising a playing field of landing sites equally spaced one from the other in an array of north-south and east-west rows, said outermost east-west rows at opposing ends of said board being base rows and the immediately inward east-west rows parallel and adjacent to said base rows being secondary rows, each said opposing base row having one landing site adapted to receive a said flight marker at the start of play, all other landing sites of the base row and of the secondary row at the same end of said board being adapted to receive offensive-defensive markers of the same set as said flight marker at said end at the start of play, airport indicia on each said base row landing site, a destination marker site outwardly adjacent each said airport indicia base row landing site for elective placement of the destination marker of the player whose flight marker is at the opposing end of said board at the start of play, and means consisting of two visually distinct diagonally adjacent landing sites medially located on said board between said secondary rows for allowing a player whose predetermined marker occupies either of said visually distinct landing sites during play to change the initially elected placement of said player's destination marker and thereby shift the flight destination of said player's flight marker.

2. The apparatus of claim 1 wherein said predetermined marker consists of said player's flight marker.

3. The apparatus of claim 1 wherein each said offensive-defensive marker is more limited in its movement capability between landing sites on said board than said flight marker.

4. The apparatus of claim 1 wherein said offensive-defensive markers consist essentially of markers representing hotair balloons, commuter jets, helicopters, a shuttle rocket, and airplanes.

5. The apparatus of claim 1 wherein said secondary row of offensive-defensive markers consists essentially of airplanes.

6. The apparatus of claim 1 wherein said offensive-defensive markers comprise a hotair balloon at the outer extremity landing site of each said base row at the start of play.

7. The apparatus of claim 1 wherein said offensive-defensive markers comprise a shuttle rocket in each base row at the start of play, said shuttle rocket being adapted to be moved solely one landing site at a time either in a north-south or east-west direction but not otherwise, and with the further limitation that said shuttle rocket is adapted to be moved only in the event an adjacent landing site in said directions of movement for said shuttle rocket is either unoccupied or occupied by an opponent's marker.

8. The apparatus of claim 1 wherein each said marker is adapted to be moved from one landing site to another within predetermined limitations on said movement during play.

9. The apparatus of claim 1 wherein each said marker other than said destination marker is adapted for movement on said board in a manner to effect cancellation of an opponent's said marker.

10. Game apparatus for flight destination play by opposing players, consisting of a playing board and two sets of seventeen movable markers, each said set including a single destination marker, a flight marker, and fifteen offensive-defensive markers representing air vehicles, with all markers of one said set visually distinct from all markers of the other said set, said board comprising a playing field of sixty-four landing sites equally spaced one from the other in an array of north-south east-west rows, with eight landing sites in each said row, said outermost east-west rows at opposing ends of said board being base rows and the immediately inward east-west rows parallel and adjacent to said base rows being secondary rows, each said opposing base row having one landing site adapted to receive a said flight marker at the start of play, all other landing sites of the base row and of the secondary row at the same end of said board being adapted to receive offensive-defensive markers of the same set as said flight marker at said end at the start of play, with each said landing site of a said secondary row occupied by an offensive-defensive air vehicle marker representing an airplane and with the remaining seven of said landing sites of said base row landing sites occupied by offensive-defensive air vehicle markers representative of hotair balloons, helicopters, commuter jets, and a shuttle rocket, each said offensive-defensive air vehicle marker being more limited in movement between landing sites on said board than said flight marker, airport indicia on each said base row landing site, a destination marker site outwardly adjacent each said airport indicia base row landing site for elective placement of the destination marker of the player whose flight marker is at the opposing end of said board at the start of play, and means consisting of two visually distinct diagonally adjacent landing sites medially located on said board between said secondary rows for allowing a player whose flight marker occupies either of said visually distinct landing sites during play to change the initially elected placement of said player's destination marker and thereby shift the flight destination of said player's flight marker.

* * * * *